United States Patent [19]

Franken

[11] Patent Number: 4,970,429

[45] Date of Patent: Nov. 13, 1990

[54] PICTURE PICK-UP DEVICE AND TELEVISION CAMERA TUBE

[75] Inventor: Adrianus A. J. Franken, Eindhoven, Netherlands

[73] Assignee: U.S. Philips Corp., New York, N.Y.

[21] Appl. No.: 843,368

[22] Filed: Mar. 24, 1986

[30] Foreign Application Priority Data

Apr. 1, 1985 [NL] Netherlands ..... 8500955

[51] Int. Cl.[5] ..... H01J 31/26

[52] U.S. Cl. ..... 313/384

[58] Field of Search ..... 313/381, 382, 383, 389, 313/390, 431, 390, 384, 442

[56] References Cited

U.S. PATENT DOCUMENTS

| | | | |
|---|---|---|---|
| 4,220,897 | 9/1980 | Barten et al. | 315/368 |
| 4,382,213 | 5/1983 | Kajimura et al. | 313/389 X |
| 4,424,466 | 1/1984 | Zeppenfeld | 313/433 |
| 4,468,587 | 8/1984 | Sluyterman | 313/442 X |
| 4,523,124 | 6/1985 | Blanken et al. | 313/446 |

FOREIGN PATENT DOCUMENTS 154081 2/1979 United Kingdom .

OTHER PUBLICATIONS

Dekkers, N. H. "A Universal Deflection Unit Generating a Field of any Order and Azimuth." *J. Phys. D; Appl. Phys.,* vol. 7, pp. 805–814, 12/1974.

Kurashige, M. "Formations of Elliptical Scanning Electron-Beam Cross Section for Removing Unscanned Area in High Resolution Camera Tubes." *Electronics and Comm. in Japan,* vol. 67-C, No. 2, pp. 54–61, 12/1984.

*Primary Examiner*—Sandra L. O'Shea

*Attorney, Agent, or Firm*—William L. Botjer

[57] ABSTRACT

Picture pickup device comprising a television camera tube having an electron gun, and a photo-sensitive target in an evacuated envelope. An electron beam generated by the electron gun is focused by focusing means onto the target. The electron beam is deflected by deflection means and describes a line raster across the target. The electron beam forms an elongated spot on the target. The longitudinal axis of the spot is perpendicular to the lines of the raster and has a length which is substantially equal to the line spacing. The elongated spot is obtained with the aid of an adjustable multipolar stigmator which, viewed in the direction of propagation of the electron beam, is provided in front of the focusing and deflection means, coaxially around the axis of the envelope and the electron gun. The shape of the spot can be adjusted in an optimum manner so that stern waves are completely suppressed. It is possible to provide the stigmator in or around the tube and to adjust it by magnetization, if required, through the wall of the envelope.

10 Claims, 2 Drawing Sheets

PICTURE PICK-UP DEVICE AND TELEVISION CAMERA TUBE

BACKGROUND OF THE INVENTION

The invention relates to a picture pickup device comprising a television camera tube. The camera tube has an electron gun in an evacuated envelope. The electron gun generates an electron beam. A photosensitive target, on which the beam is focused by focusing means and across which the beam is deflected by deflection means, is also arranged in the envelope. The deflected beam describes a line raster, on the target. The electron beam forms an elongated spot on the target. The longitudinal axis of the spot is perpendicular to the lines of the raster and has a length which is substantially equal to the line spacing.

The invention also relates to a television camera tube.

A picture pickup device and camera tube of this type are described in an article by M. Kurashige entitled "Formations of Elliptical Scanning Electron-Beam Cross Section for Removing Unscanned Area in High Resolution Camera Tubes" (*Electronics and Communications*). In Japan, Vol. 67-C, No. 2, pages 54–61 1984 (translated from Denshi Tsushin Gakkai Ronbunshi, Vol. 66-C, No. 9, Sept. 1983, pages 638–645). In this article it is proposed to remove electric charge stored in unscanned areas between the lines scanned on the target by giving the spot an elliptic shape or by rapidly moving a round spot up and down over a short distance with the aid of a radio-frequency electric field. The latter is referred to as wobbling. The elliptic spot is obtained with the aid of an elongated aperture in an electrode.

This method is applicable to a tube having magnetic focusing and deflection means, although the direction of the longitudinal axis of the spot changes slightly depending on the position of the spot on the target. This method is also applicable to an electrostatically focused tube with magnetic deflection. However, according to the kurashige article such a tube has a poor resolution. The direction of elongation of the spot is, however, independent of the position of the spot on the target. Wobbling may be used with tubes having magnetic focusing and electrostatic deflection.

The drawback of an elongated aperture in an electrode is that the extent of elongation of the spot can no longer be adjusted after the camera tube has been positioned in the deflection coils and/or focusing coil. Due to small differences between coils and small errors in the alignment of tube and coils with respect to each other, this adjustability is desirable. The drawback of wobbling in systems using magnetic deflection is that the high frequencies desired during wobbling generate interference in the deflection coils.

A disturbing phenomenon in pickup tubes is the stern-wave effect, which occurs particularly in tubes having a diode electron gun. This phenomenon occurs when a bright object (a bright portion of the picture) moves against a dark background. In that case a stern wave (a plurality of dark and light stripes decreasing in contrast and length) follows the object. It is not quite clear what these stern waves are caused by. It is, however, clear that they disappear when the spot is elongated and fills the space between two picture lines.

SUMMARY OF THE INVENTION

It is therefore an object of the invention to provide a picture pickup device in which the desired spot dimensions can be accurately adjusted so as to make it possible to completely suppress the stern-wave effect in all tube types using magnetic or electrostatic deflection and magnetic or electrostatic focusing.

According to the invention, in a picture pickup device the elongated spot is obtained with the aid of an adjustable multipolar stigmator. Viewed in the direction of propagation of the electron beam, the stigmator is provided in front of the focusing and deflection means coaxially around the axis of the envelope and the electron gun.

A stigmator for electron beam correction is described in an article by N. H. Dekkers entitled "A universal deflection unit generating a field of any order and azimuth" (*Journal Phys. D: Appl. Phys.*; Vol. 7, pages 805–814, 1974). The field distribution and operation of such a stigmator has been described extensively in this article and will not be repeated here. The stern waves can be suppressed entirely when such a stigmator is used in a picture pickup device.

The stigmator may be, for example, a quadrupolar stigmator. The stigmator must be adjustable, so that the beam shape can be optimized after the tube has been positioned in the camera.

When the stigmator is an adjustable octupole, the beam can be shaped to a still greater extent. In addition it is easier to generate not only a quadrupole but also a dipole component for optimum beam alignment.

The stigmator may consist of a plurality of permanent magnetic rings which are rotatable with respect to each other. Alternately, the stigmator may comprise a plurality of coils regularly spaced around the outside of the envelope around the axis of the envelope and the gun. The stigmator may alternatively be accommodated in the tube.

According to the invention a television camera tube comprises an adjustable multipolar stigmator for producing an elongated electron beam spot. The stigmator comprises a magnetizable structure which, viewed in the direction of propagation of the electron beam, is provided in front of the focusing and deflection means coaxially around the gun axis in or around the envelope. The magnetizable structure's being adjusted by magnetization is adjusted in such a manner that the length of the spot is substantially equal to the line spacing.

This structure may be, for example, a ring of a magnetic half-hard material which is mainly magnetized as a quadrupole. It stands to reason however, that the magnetizable structure is not limited to a ring and may alternatively have a different shape. Thus, it is possible to place a plurality of magnetizable elements in a ring of a nonmagnetic material around the axis of electron gun either inside or outside the envelope and to subsequently magnetize these elements after the gun has been mounted in the tube. The ring consists of a magnetic hard-half material to provide for magnetization in the tube.

A material as described in German Patent No. 2,612,607 (corresponding to British Patent No. 1,540,817) is, for example, suitable for use in any the preceding embodiment of the invention. This material consists of, for example, an alloy of Fe, Co, V and Cr, which is known under the tradename of Koërflex. The material may be magnetized as a multipole, for example, a quadrupole, in a manner and with the aid of a magnetizing device described in U.S. Pat. No. 4,220,897.

U.S. Pat. No. 4,424,466 describes a picture display tube having one or two electron beams and using electrostatic deflection and focusing. One or more rings magnetized as a multipole have been placed around the electron beam in the tube, in part for correcting deflection errors.

There is, for example, a ring between the two sets of deflection plates and the display screen and/or a ring near the cathode. The ring near the cathode serves to shape the beam, rendering the spot truly round. In this electron gun the structure magnetized as a multipole is used in a display tube, with a completely different purpose than in the electron gun in the picture pickup device according to the present invention.

DESCRIPTION OF THE PREFERRED EMBODIMENTS

Figure 1:
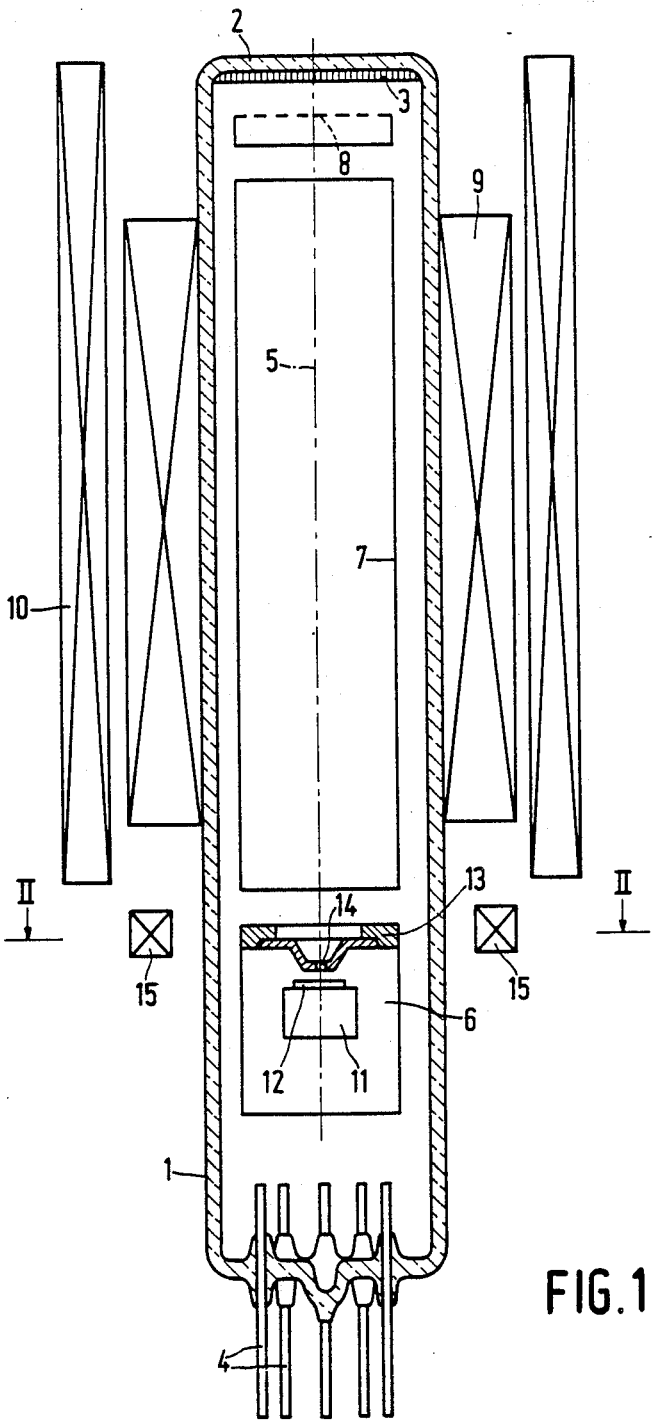
FIG. 1 is a longitudinal section through a picture pickup device according to the invention.

The camera tube of the picture pickup device shown in FIG. 1 is of the "Plumbicon" (trademark) type. It comprises a glass envelope 1 having a window 2 at one end and a photo-sensitive target 3 provided on the inside of said window 2.

The target 3 consists of a photoconductive layer and a transparent conductive signal plate between the photosensitive layer and the window 2. The photosensitive layer consists predominantly of specially activated lead monoxide. The signal plate consists of conductive tin oxide.

The connecting pins 4 of the tube are provided at the other end of the glass envelope 1. Centered along its longitudinal axis 5, the camera tube includes a diode electron gun 6 and a collector 7. In addition, the tube includes a gauze-like electrode 8 which causes the electron beam to land perpendicularly on the target 3.

The deflection coils 9 deflect the electron beam generated by the electron gun 6 in two mutually perpendicular directions. The electron beams scans a line raster on the target 3. The focusing coil 10 focuses the electron beam on the target 3.

Focusing and/or deflection may of course alternatively be performed electrostatically with the aid of electrodes provided in the tube.

The diode electron gun 6 includes a cathode 11 having an emitting surface 12 and an anode 13. (For simplicity, FIG. 1 does not show the connections of these components to the connection pins 4). The anode 13 has a small, round aperture 14 such that it also forms a diaphragm.

The electron gun 6 may alternatively comprise a triode electrode gun.

The stigmator, two coils 15 of which are visible in FIG. 1, is provided approximately at the area of the anode 13.

Figure 2:
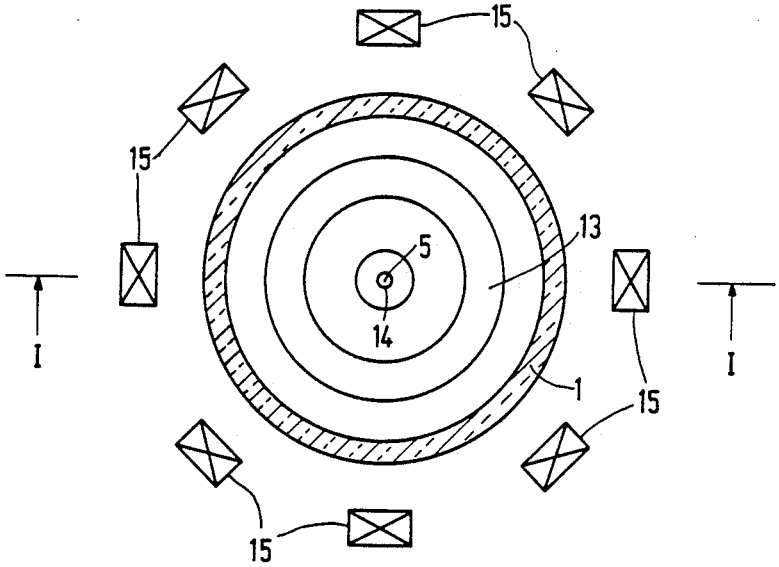
FIG. 2 is a cross-sectional view of an octapolar stigmator on line II—II of FIG. 1.

FIG. 2 is a cross-section through the device of FIG. 1. This stigmator consists of eight coils 15 which are provided in a regularly spaced manner around the axis 5 of the envelope 1.

It is possible to make a true quadrupole with these eight coils by energizing the coils at the top and at the bottom and at the left and right. It is, however, alternatively possible to make a combination of multipoles with these eight coils, such as, for example, a dipole and a quadrupole. In addition to generating an elongated spot, beam alignment is thus also possible with a dipole.

It is alternatively possible to generate higher-order poles with these coils 15 by which the shape of the spot can be perfected.

Figure 3:
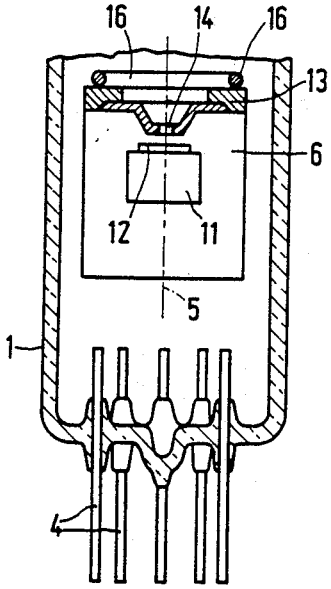
FIG. 3 is partial longitudinal section through a camera tube according to the invention.

FIG. 3 shows a partial longitudinal section of a part of an alternative embodiment according to the invention. In the tube shown in FIG. 3, the deflection and focusing means are provided in the envelope 1. In this case the stigmator consists of a Koërflex ring 16 secured to the anode 13 of the diode gun 6. The other components have the same reference numerals as the corresponding components in FIG. 1.

The stigmator 16 is adjusted by magnetization through the wall of the envelope 1. It is of course alternatively possible to manufacture the stigmator from a ring or tape of magnetizable material provided against the inner or outer wall of the envelope. In that case the stigmator may also be magnetized to a multipole from the exterior.

What is claimed is:

1. A picture pickup device comprising a television camera tube, said tube comprising:

an evacuated envelope having a front end and a back end;

a photosensitive target arranged in the envelope toward the back end;

an electron gun arranged in the envelope toward the front end to generate an electron beam, said gun having an axis;

means for focusing the electron beam onto the target to form an electron beam spot; and deflection means for scanning the electron beam across the target in a raster of horizontal lines spaced a distance apart;

characterized in that:

the electron beam spot has an elongated shape with a length and a width smaller than the length, the length being substantially perpendicular to the horizontal lines of the raster, the length being substantially equal to the distance between adjacent horizontal lines of the raster; and the device further comprises an adjustable multipolar stigmator arranged in front of the focusing means and the deflection means, said adjustable multipolar stigmator being arranged substantially coaxially around the electron gun, said adjustable multipolar stigmator shaping the electron beam spot in its elongated shape.

2. A picture pickup device as claimed in claim 1, characterized in that the adjustable multipolar stigmator comprises means for generating an adjustable magnetic quadrupole field.

3. A picture pickup device as claimed in claim 2, characterized in that the adjustable multipolar stigmator comprises two permanent magnetic rings which are rotatable relative to one another.

4. A picture pickup device as claimed in claim 2, characterized in that the adjustable multipolar stigmator comprises a plurality of coils arranged regularly spaced around the electron gun axis.

5. A picture pickup device as claimed in claim 1, characterized in that the adjustable multipolar stigmator comprises means for generating an adjustable magnetic octupole field.

6. A picture pickup device as claimed in claim 5, characterized in that the adjustable multipolar stigmator comprises two permanent magnetic rings which are rotatable relative to one another.

7. A picture pickup device as claimed in claim 5, characterized in that the adjustable multipolar stigmator comprises a plurality of coils arranged regularly spaced around the electron gun axis.

8. A television camera tube comprising:

an evacuated envelope having a front end and a back end;

a photosensitive target arranged in the envelope toward the back end;

an electron gun arranged in the envelope toward the front end to generate an electron beam, said gun having an axis;

means for focusing the electron beam onto the target to form an electron beam spot; and deflection means for scanning the electron beam across the target in a raster of horizontal lines spaced a distance apart;

characterized in that:

the electron beam spot has an elongated shape with a length and a width smaller than the length, the length being substantially perpendicular to the horizontal lines of the raster, the length being substantially equal to the distance between adjacent horizontal lines of the raster; and the device further comprises an adjustable multipolar stigmator arranged in front of the focusing means and the deflection means, said adjustable multipolar stigmator being arranged substantially coaxially around the electron gun, said adjustable multipolar stigmator shaping the electron beam spot in its elongated shape.

9. A television camera tube as claimed in claim 8, characterized in that the adjustable multipolar stigmator comprises a ring of magnetic material, said magnetic material being half-hard, said ring being magnetized to generate a substantially quadrupole field.

10. A television camera tube comprising:

an evacuated envelope;

a photosensitive target arranged in the envelope;

an electron gun arranged in the envelope to generate an electron beam, said gun having an axis;

means for focusing the electron beam onto the target to form an electron beam spot; and deflection means for scanning the electron beam across the target in a raster of horizontal lines;

characterized in that:

the electron beam spot has an elongated shape with a length and a width smaller than the length; and the device further comprises an adjustable multipolar stigmator arranged substantially coaxially around the electron gun, said adjustable multipolar stigmator shaping the electron beam spot in its elongated shape.

* * * * *